US006146210A

United States Patent [19]

Cha et al.

[11] Patent Number: 6,146,210

[45] Date of Patent: Nov. 14, 2000

[54] CONNECTOR ASSEMBLY THAT PREVENTS POLARIZATION PROBLEMS AND USES A SINGLE APERTURE TO PERFORM BOTH LATCHING FUNCTIONS AND GUIDE FUNCTIONS

[75] Inventors: Jung-Woo Cha, Suwon; Kwang-Youb Lee, Seoul, both of Rep. of Korea

[73] Assignee: SamSung Electronics Co., Ltd., Suwon, Rep. of Korea

[21] Appl. No.: 09/302,427

[22] Filed: Apr. 30, 1999

[30] Foreign Application Priority Data

Apr. 30, 1998 [KR] Rep. of Korea ..... 98-15595

[51] Int. Cl.[7] ..... H01R 13/64

[52] U.S. Cl. ..... 439/680; 439/353; 439/289; 439/374

[58] Field of Search ..... 439/680, 289, 439/353, 358, 357, 924.1, 101, 378, 379, 374

[56] References Cited

U.S. PATENT DOCUMENTS

| | | | |
|---|---|---|---|
| 3,364,458 | 1/1968 | Black, Jr. et al. | 439/680 |
| 3,394,337 | 7/1968 | Miller | 439/353 |
| 3,409,859 | 11/1968 | Krehbiel | 439/357 |
| 3,692,966 | 9/1972 | Lancaster | 200/51.1 |
| 3,731,259 | 5/1973 | Occhipinti | 339/66 M |
| 3,828,302 | 8/1974 | Cieniawa et al. | 339/91 R |
| 4,179,178 | 12/1979 | Bachman et al. | 339/111 |
| 4,842,543 | 6/1989 | Davis | 439/378 |
| 5,332,330 | 7/1994 | Kaneko | 403/321 |
| 5,346,412 | 9/1994 | Fedder et al. | 439/681 |
| 5,356,300 | 10/1994 | Costello et al. | 439/101 |
| 5,466,171 | 11/1995 | Bixler et al. | 439/378 |
| 5,486,117 | 1/1996 | Chang | 439/357 |
| 5,486,118 | 1/1996 | Colleran et al. | 439/374 |
| 5,620,329 | 4/1997 | Kidd et al. | 439/248 |
| 5,813,877 | 9/1998 | Nakamura | 439/267 |
| 5,885,088 | 3/1999 | Brennan et al. | 439/680 |

*Primary Examiner*—Lincoln Donovan
*Assistant Examiner*—Javad Nasri
*Attorney, Agent, or Firm*—Robert E. Bushnell, Esq.

[57] ABSTRACT

A connector assembly for electrically connecting a first and a second electronic unit, comprises a plug provided in the first electronic unit to have a plurality of spring pins and a second rigid pin, the plug be mounted in a plug housing, and a socket provided in the second electronic unit to have a plurality of first pin contacts corresponding to the spring pins and a second pin contact with a hole for receiving the second rigid pin, whereby the spring pins resiliently contact respective ones of the first pin contacts with the second rigid pin received by the hole of the second pin contact, or are obstructed by the second rigid pin from contacting the first pin contacts according as the plug is correctly inserted into the socket or not.

14 Claims, 6 Drawing Sheets

CONNECTOR ASSEMBLY THAT PREVENTS POLARIZATION PROBLEMS AND USES A SINGLE APERTURE TO PERFORM BOTH LATCHING FUNCTIONS AND GUIDE FUNCTIONS

CLAIM OF PRIORITY

This application makes reference to, incorporates the same herein, and claims all benefits accruing under 35 U.S.C. §119 from an application for CONNECTOR ASSEMBLY earlier filed in the Korean Industrial Property Office on Oct. 25, 1996 and there duly assigned Ser. No. 48509/1996 and on Apr. 30, 1998 and there duly assigned Ser. No. 15595/1998.

1. Field of The Invention

The present invention concerns a connector assembly, especially for electrically connecting two electronic units.

2. Description of the Related Art

Portable personal computers that can be put in a pocket are called wallet PC, PDA (personal digital assistant), HPC (hand-held personal computer), etc. Such palm-sized computers are being more and more popularized because they are more advantageous in portability than notebook computers, and moreover may interact with other electronic apparatuses such as computer, printer, scanner, etc. through a connector assembly consisting of a plug and a socket. The plug generally has spring pins resiliently connected with the socket. The conventional connector assembly suffers the flowing drawbacks.

First, the plug may be connected with the socket even if its position is reversed. In such case, the data transmission can not be performed, and further, the electronic circuits wrongly contacted by the plug may be damaged. Hence, the user must be always very careful so as to avoid the reverse connection of the plug and socket. Second, if a force is inadvertently exerted to the plug connected with the socket, there occurs contact failure between the socket contacts and the spring pins because the spring pins are displaced from the normal positions to effectively contact the socket contacts. This causes stopping of the data transmission performed between the palm-sized computer and an external electronic device.

U.S. Pat. No. 5,486,117 for a Locking System For an Electrical Connector Assembly to Chang discloses a latch arm located for manual deflection to move a hook portion out of engagement the latching surface to allow unmating of the connectors with minimal force. U.S. Pat. No. 5,356,300 for a Blind Mating Guides With Ground Contacts to Costello et al. disclose alignment posts that align the mating face with the mating electrical connector prior to connection of the mating face with the mating electrical connector. U.S. Pat. No. 3,692,966 for a Multi-Circuit Patch Plug and Jack to Lancaster discloses a guide member that protrudes beyond the lower end and forward edge of the body, and provides a means of assuring proper orientation of the plug for entry into the jack slots.

However, I have not seen the combination of each of these features in a single reference. In addition, I have not seen a polarizing means where one electrical pin is extended beyond the other pins for proper orientation. Further, I have not seen a guiding means and a latching means that use the same aperture in the socket to perform both latching functions and guiding functions.

SUMMARY OF THE INVENTION

It is an object of the present invention to provide a computer with a connector assembly which prevents the plug from being reversely connected with the socket.

It is an other object of the present invention to provide a connector assembly with means for preventing inadvertent displacement of the plug connected with the socket.

It is yet another object to provide a polarizing means whereby one of the electrical connections is longer than the other electrical connections requiring the user to insert the plug into the socket in only one possible orientation, the correct one.

It is still yet another object of the present invention to provide a guiding means and a latching means for a connector that both make use of a single aperture in the socket.

It is still also another object to combine the above polarizing techniques with the above guiding means and latching means into a single plug that can be more user friendly.

According to an embodiment of the present invention, a connector assembly for electrically connecting a first and a second electronic unit, comprises a plug provided in the first electronic unit to have a plurality of first resilient connecting pins and a second rigid pin, the plug be mounted in a plug housing, and a socket provided in the second electronic unit to have a plurality of first pin contacts corresponding to the first resilient pins and a second pin contact with a hole for receiving the second rigid pin, whereby the first resilient pins resiliently contact respective ones of the first pin contacts with the second rigid pin received by the hole of the second pin contact, or are obstructed by the second rigid pin from contacting the first pin contacts according as the plug is correctly inserted into the socket or not. Preferably, the socket has a pair of guide holes respectively formed at both its sides, and the plug has a pair of guide ribs projected at both its sides, whereby the guide ribs are respectively inserted into the guide holes upon connecting the plug and socket to prevent the plug from being displaced in the socket. In addition, the socket has a pair of catches formed at both its sides to catch respectively a pair of ejection members provided at both sides of the plug so as to prevent the plug inserted in the socket from being inadvertently removed. The second rigid pin is electrically connected with ground line, and the first resilient pins respectively with signal lines and positive power line. At least, one of the first and second electronic units is a computer system.

The present invention will now described more specifically with reference to the drawings attached only by way of examples.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
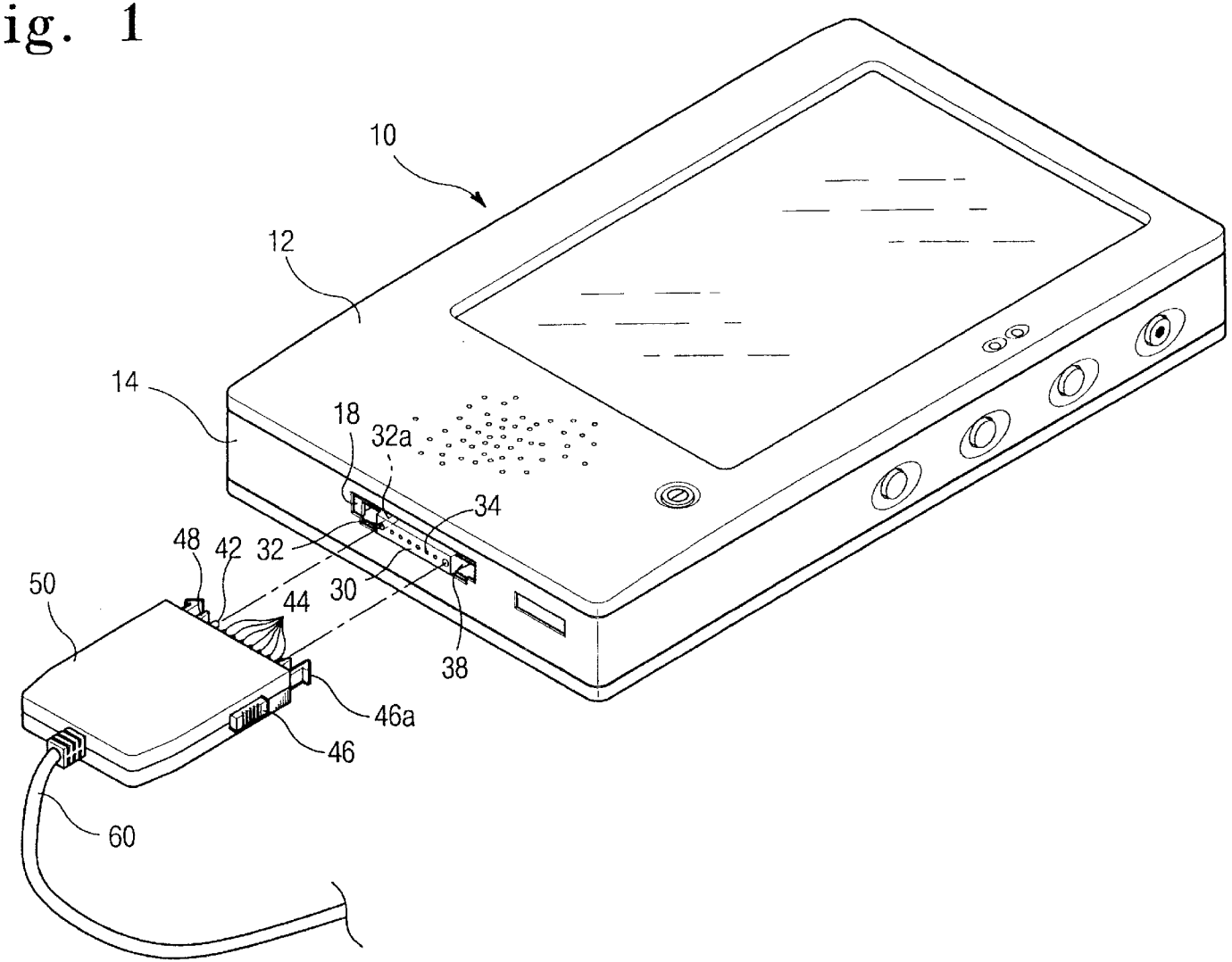
FIG. 1 is a perspective view for illustrating a connector assembly of a palm-sized computer according to the present invention.
Figure 2:
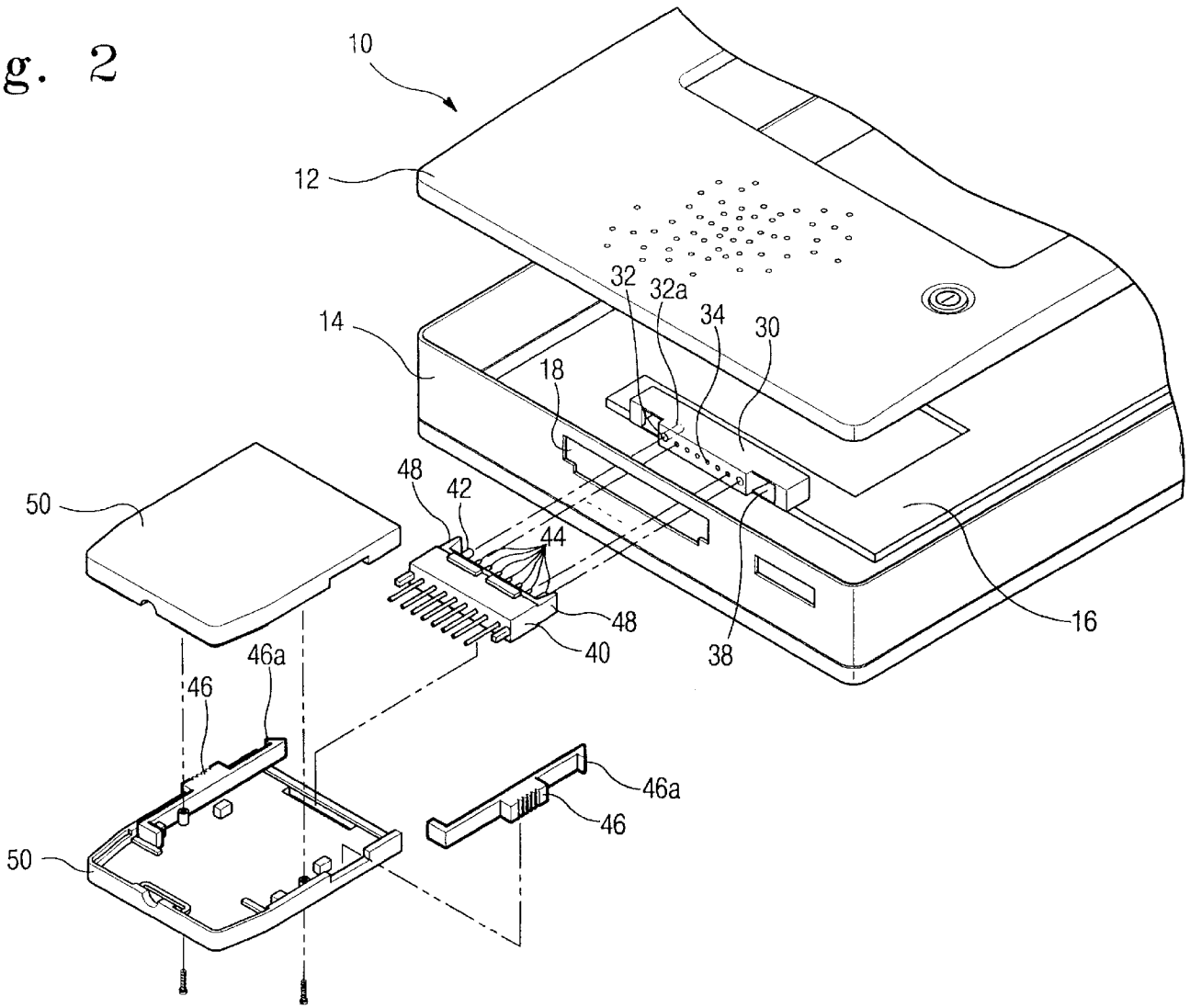
FIG. 2 is an exploded perspective view for illustrating a connector assembly as shown in FIG. 1.
Figure 3:
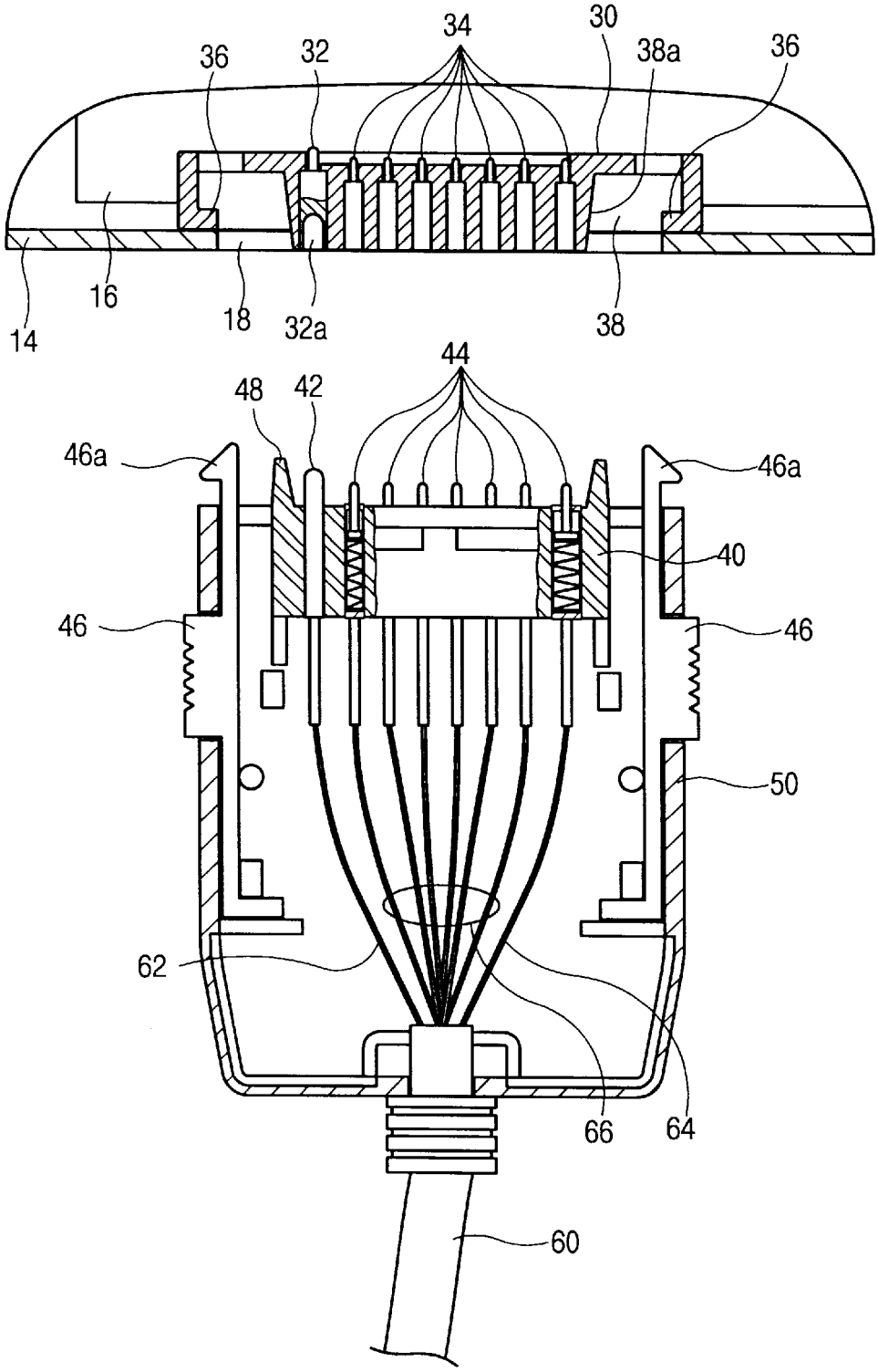
FIG. 3 is a partial cross sectional view for illustrating the structure of a connector assembly according to the present invention.

Referring to FIGS. 1 to 3, a connector assembly comprises a plug 40, socket 30, plug housing 50, and a pair of releasing members 46. A palm-sized PC 10 comprises a top housing 12, bottom housing 14, and an electronic circuit board 16 mounted in the internal space between them. It will be noted that various electronic devices and power supply are installed in that internal space.

The plug 40 includes a plurality of first spring pins 44 and a second positioning pin 42. The spring pins 44 are conventionally designed to resiliently connect with the socket, as shown in FIG. 3. The positioning pin 42 is preferably designed to be longer than the spring pins 44, rigidly mounted in the plug 40. The positioning pin 42 serves both for electrical connection and for correct positioning of the plug with the socket. The plug 40 is mounted in the plug housing 50 with the spring pins 44 and positioning pin 42 protruded externally.

The socket 30 is mounted on the electronic circuit board 16 of the computer 10, exposed through an opening 18 formed in one side of the bottom housing 14 so as to connect with the plug 40. The socket 30 has a plurality of first pin contacts 34 positioned corresponding to the first spring pins 44, and a second pin contact 32 positioned corresponding to the second positioning pin 42. The first pin contacts 34 respectively make electrical connections with the corresponding first spring pins 44, and the second pin contact 32 receiving the second positioning pin 42, when the plug 40 is inserted into the socket 30. In this case, the second positioning pin contact 32 has a receiving hole 32*a* to receive the second positioning pin 42 when the plug 40 is correctly inserted into the socket 30. Thus, the positioning pin 42 and positioning pin contact 32 serve to prevent the plug 30 from being reversely inserted into the socket 30.

The plug 40 is connected with a cable 60 such as RS232C cable (RS232C is a standard specified by American Electronic Industries Association for data transmission between computers through a direct port). The cable 60 includes six signal lines 66, and two power lines consisting of a ground line 62 and a plus line 64. The six signal lines 66 and plus line 64 are electrically connected with their respective first spring pins 44. The ground line 62 is electrically connected with the second positioning pin 42. The number of the first spring pins and corresponding pin contacts 34 may be increased as desired.

Figure 4:
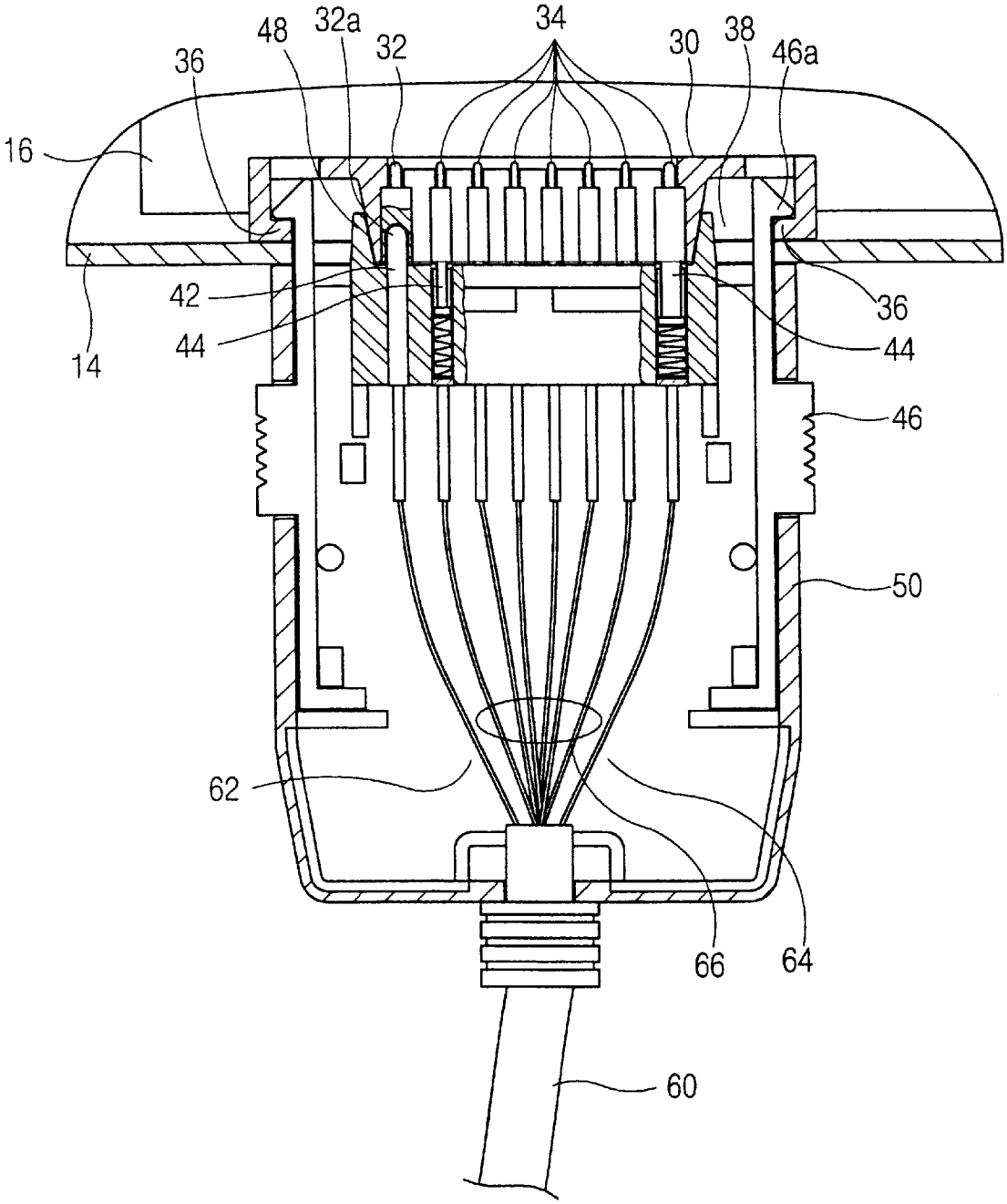
FIG. 4 is a cross sectional view for illustrating the plug correctly inserted into the socket in a connector assembly as shown in FIG. 3.

Preferably, the socket 30 has a pair of guide holes 38 respectively formed at both of its sides, and the plug 40 has a pair of guide ribs 48 projected at both its sides, so that the guide ribs 48 may be respectively inserted into the guide holes 38 to prevent the plug 40 from being displaced in the socket 30 upon connecting the plug and socket, as shown in FIG. 4. In addition, the socket 30 has a pair of catches 36 formed at both its sides to catch respectively a pair of hooks 46*a* so as to prevent the plug 40 inserted in the socket 30 from being inadvertently removed. The hooks 46*a* are respectively formed on the ends of a pair of releasing members 46 provided at both sides of the plug housing 50.

Figure 3A:
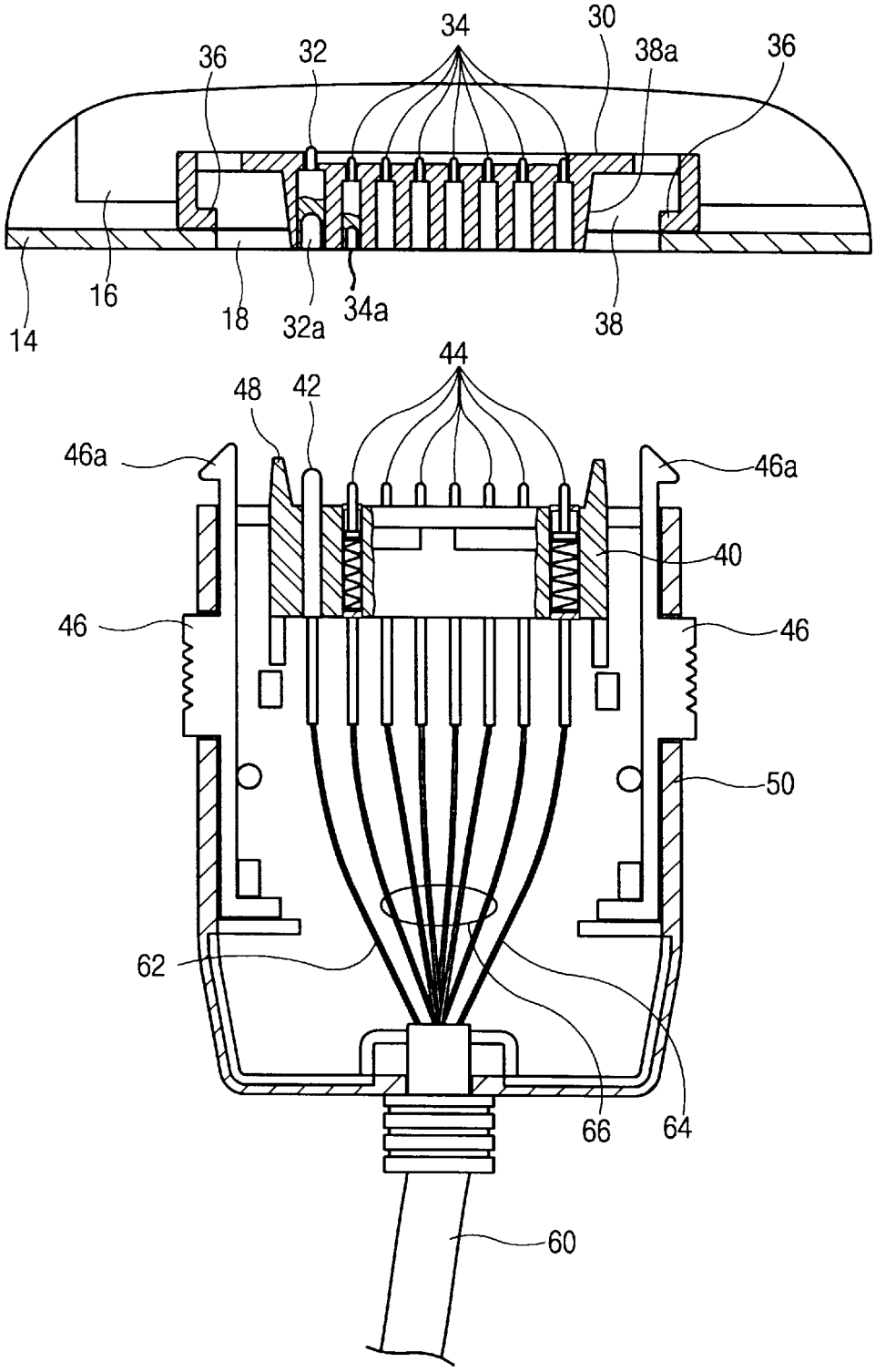
FIG. 3A is a partial cross sectional view illustrating an alterative construction of the connector assembly shown by FIG. 3.

In operation, pushing the plug housing 50 towards the socket 30, the positioning pin 42 is inserted into the receiving hole 32*a* of the second positioning pin contact 32. Meanwhile, the first spring pins 44 resiliently contact the first pin contacts 34 through the springs compressed when the positioning pins 44 are pushed towards the first pin contacts 34, as shown in FIG. 4. As soon as the plug 40 is completely inserted into the socket 30, the hooks 46*a* of the releasing members 46 are engaged with the catches 36 of the socket 30 so as to prevent the plug 40 from being inadvertently removed from the socket 30. Alternatively, as shown in FIG. 3A, receiving holes 34*a* of pin contacts 34 receive pins 44. In addition, the guide ribs 48 are inserted into the guide holes 38 so that the inside surfaces of the guide ribs 48 contact the inside surfaces 38*a* of the guide holes 38. This prevents the plug 40 from being displaced in the socket 30 even when an external force is inadvertently exerted to the plug inserted in the socket. In order to detach the plug 40 from the socket 30, the releasing members 46 are inwardly pressed from the outside of the plug housing 50, so that the hooks 46*a* of the releasing members are inwardly moved and released from the catches 36 of the socket 30. Then, the plug housing 50 is pulled to detach the plug 40 from the socket 30.

Figure 5:
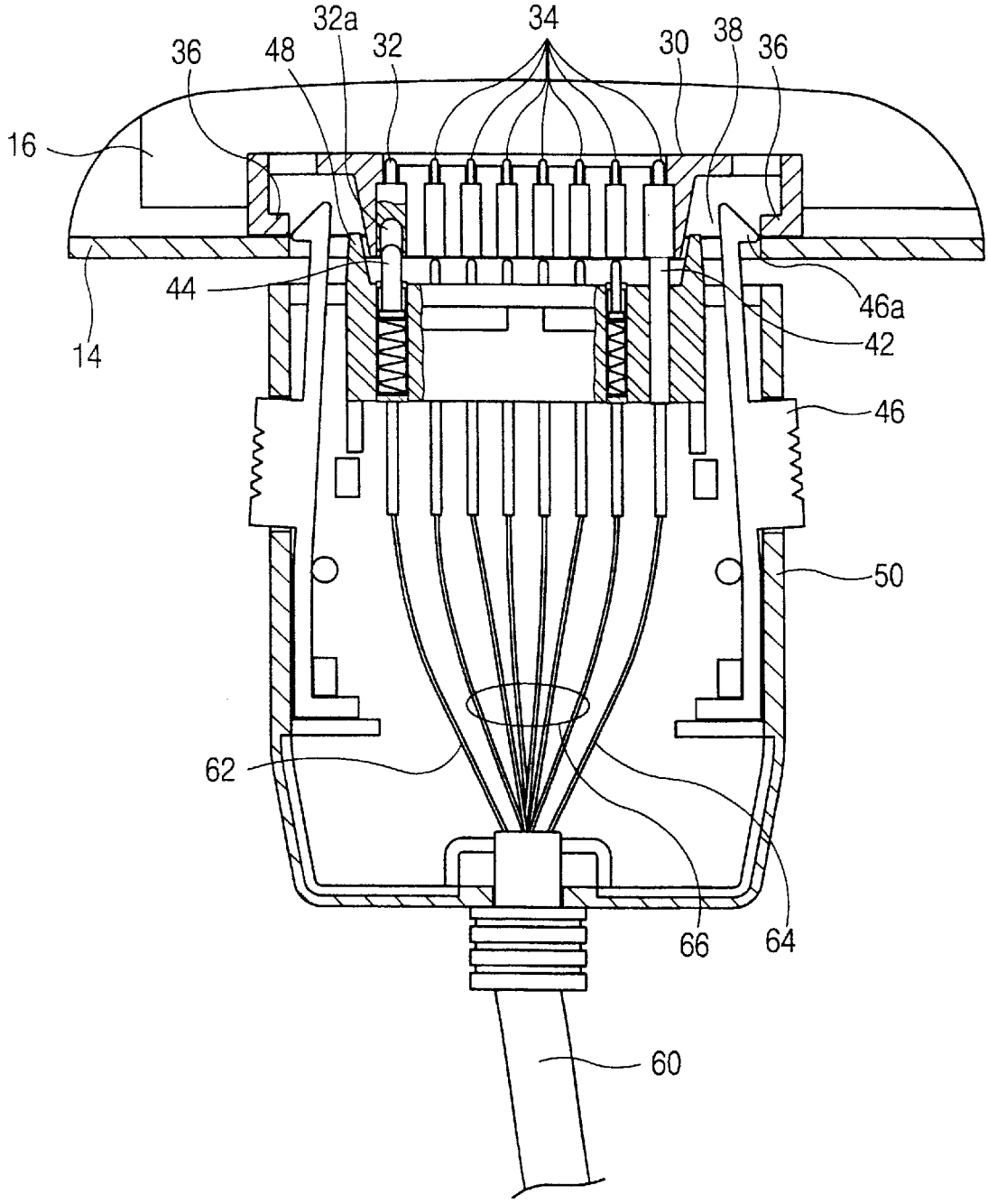
FIG. 5 is a cross sectional view similar to FIG. 4 but the plug incorrectly inserted into the socket.

However, as shown in FIG. 5, it is impossible to insert the reversed plug 40 into the socket 30 since the positioning pin 42 contacts the first pin contact 34 instead of the positioning pin contact 32. In this case, the positioning pin 42 may not be inserted into the first pin contact 34, so that the hooks 46*a* of the releasing members 46 are not engaged with the catches 36, and the first spring pins 44 do not contact the first pin contacts 34. Further, even if the positioning pin 42 makes a conductive contact with the socket 30, the electronic circuits of the board 16 are not damaged since the positioning pin 42 is connected with the ground line 62. Thus, the inventive connector assembly does not allow the complete electrical connection with the reversed plug 40, quickly notifying the user of the incorrect connection of the plug 40 with the socket 30.

While the present invention has been described in connection with specific embodiments accompanied by the attached drawings, it will be readily appreciated by those skilled in the art that various changes and modifications may be made thereto without departing the gist of the present invention.

What is claimed is:

1. A connector assembly for electrically connecting a first and a second electronic unit, comprising:

a plug provided in said first electronic unit, with a plurality of first resilient connecting pins and a second rigid pin, said plug being mounted in a plug housing having a pair of releasing members spaced apart within said housing by said plug, said releasing members having distal ends terminated by hooks; and a socket provided in said second electronic unit, with a plurality of first pin contacts corresponding to said first resilient pins and a second pin contact with a hole removably receiving said second rigid pin, said second rigid pin and said second pin contact preventing improper orientation of said plug into said socket upon mating of said plug with said socket, said socket having a pair of guide holes formed at opposite sidewalls, and said plug having a pair of guide ribs projecting along opposite sides, said guide ribs being removably insertable inserted into said guide holes upon during said mating, said socket having a pair of catches formed along said opposite sidewalls sides to catch said hooks and prevent said plug inserted in said socket from being inadvertently removed, said second rigid pin protruding further from said plug than each of said plurality of first resilient connecting pins and said second pin contact extending deeper into said socket than each of said first pin contacts.

2. The connector assembly as defined in claim 1, wherein said catches formed at both sides of said socket are formed in said guide holes.

3. The connector assembly as defined in claim 1, wherein said second rigid pin is electrically connected with ground line, and said first resilient pins respectively are electrically connected with signal lines and a positive power line.

4. An electrical connector, comprising:

a plug having a mating surface having a central portion and a left side and a right side portion, comprising:

a first plurality of first spring pins protruding from said central portion of said mating surface of said plug;

a second positioning pin protruding from one of said left or said right side portion of said mating surface of said plug, said second positioning pin being longer than each of said first plurality of first spring pins;

a pair of guide ribs protruding from said mating surface, one of said pair of guide ribs extending from said right side portion of said mating surface and the other of said pair of guide ribs extending from said left side portion of said mating surface; and a pair of hooks protruding from said mating surface, one of said pair of hooks extending from said right side portion of said mating surface and the other of said pair of hooks extending from said left side portion of said mating surface;

a socket having a mating surface having a central portion and a left side and a right side portion corresponding to said central portion and said left side and said right side portions of said plug, said socket comprising:

a first plurality of pin contacts for mating with said first plurality of first spring pins, said first plurality of pin contacts being at said central portion of said mating surface of said socket;

a single positioning pin contact to mate with said second positioning pin, said single positioning pin contact being located on either the left side or the right side portion of said mating surface of said socket to allow said plug to be inserted into said socket in only one orientation, said single positioning pin contact having a deeper hole than said first plurality of pin contacts to accommodate said second positioning pin; and a pair of guide holes, one of said pair of guide holes being located at said right side of said mating surface of said socket and the other of said pair of guide holes being located at the left side portion of said mating surface of said socket, each guide hole having a first interior surface and a second interior surface, said first interior surface accommodating one of said pair of guide ribs and said second interior surface being notched to form a catch to lock one of said hooks into said socket.

5. The electrical connector of claim 4, wherein said hooks of said plug are connected to releasing members allowing a user to connect and disconnect said plug from said socket.

6. The electrical connector of claim 4, wherein said second positioning pin is connected to a ground line of said plug, causing said positioning pin contact to be grounded when said plug is mated with said socket.

7. The electrical connector of claim 4, wherein said first plurality of first spring pins include six signal lines and one power plus line.

8. An electrical connector, comprising:

a plug having a mating surface having a central portion and left and right side portions of said mating surface, comprising:

a plurality of pins protruding from said central portion of said mating surface of said plug;

a pair of guide ribs protruding from said mating surface, one of said pair of guide ribs extending from said right side portion of said mating surface and the other of said pair of guide ribs extending from said left side portion of said mating surface; and a pair of hooks protruding from said mating surface, one of said pair of hooks extending from said right side portion of said mating surface and the other of said pair of hooks extending from said left side portion of said mating surface;

a socket having a mating surface having a central portion and a left side and a right side portion corresponding to said central portion and said left side and said right side portions of said plug, said socket comprising:

a plurality of pin contacts for mating with said plurality of pins, said plurality of pin contacts being at said central portion of said mating surface of said socket; and a pair of guide holes, one of said pair being located at said right side of said mating surface of said socket and the other of said pair of guide holes being located at the left side portion of said mating surface of said socket, each guide hole having a first interior surface and a second interior surface, said first interior surface accommodating one of said pair of guide ribs and said second interior surface being notched to form a catch to lock one of said hooks into said socket.

9. The electrical connector of claim 8, wherein said plurality of pins comprise a first plurality of first spring pins and a second positioning pin, said second positioning pin having a different shape than said first plurality of first spring pins.

10. The electrical connector of claim 9, wherein said plurality of pin contacts comprise a first plurality of first pin contacts which mate with said first plurality of first spring pins and a positioning pin contact which mates with said second positioning pin.

11. The electrical connector of claim 10, wherein said second positioning pin is longer than each of said first plurality of first spring pins.

12. The electrical connector of claim 10, wherein said second positioning pin is wider than each of said first plurality of first spring pins.

13. An electrical connector, comprising:

a plug having a mating surface having a central portion and left and right side portions of said mating surface, comprising:

a plurality of pins protruding from said central portion of said mating surface of said plug;

a guide rib protruding from said mating surface, said guide rib extending from said right side portion of said mating surface; and a hook spaced-apart from said guide rib, protruding from said mating surface, from said right side portion of said mating surface;

a socket having a mating surface with a central portion and a left side and a right side portion corresponding to said central portion and said left side and said right side portions of said plug, said socket comprising:

a plurality of pin contacts for mating with said plurality of pins, said plurality of pin contacts being at said central portion of said mating surface of said socket; and a guide hole located at a left side portion of said mating surface of said socket, said guide hole having a first interior surface and a second interior surface spaced-apart from said first interior surface, said first interior surface accommodating said guide rib and said second interior surface being notched to form a catch to removably engage said hook into said socket.

14. The electrical connector of claim 13, wherein said plurality of pins comprise a first plurality of first spring pins and a second positioning pin, said second positioning pin having a different shape than said first plurality of first spring pins.

* * * * *